US008383996B2

(12) United States Patent
Woelper et al.

(10) Patent No.: US 8,383,996 B2
(45) Date of Patent: Feb. 26, 2013

(54) ELECTRICAL CARTRIDGE HEATER WITH SUPPLY CABLE

(75) Inventors: Hendrik Woelper, Schwelm (DE); André Dunse, Wuppertal (DE)

(73) Assignee: Hotset Heizpatronen U. Zubehoer GmbH, Luedenscheid (DE)

( * ) Notice: Subject to any disclaimer, the term of this patent is extended or adjusted under 35 U.S.C. 154(b) by 256 days.

(21) Appl. No.: 12/968,207

(22) Filed: Dec. 14, 2010

(65) Prior Publication Data

US 2011/0139768 A1 Jun. 16, 2011

(30) Foreign Application Priority Data

Dec. 14, 2009 (DE) ..... 10 2009 044 877

(51) Int. Cl.
*H05B 3/02* (2006.01)
*H01C 1/02* (2006.01)

(52) U.S. Cl. ..... 219/538; 219/541; 219/536; 219/534; 219/202; 219/205; 219/206; 219/208; 338/229; 338/233; 338/238; 338/240

(58) Field of Classification Search ..... 219/202, 219/205, 206, 208, 534, 536, 538, 541; 338/229, 338/233, 238, 240
See application file for complete search history.

(56) References Cited

U.S. PATENT DOCUMENTS 4,622,455 A 11/1986 Schwarzkopf

*Primary Examiner* — Shawntina Fuqua
(74) *Attorney, Agent, or Firm* — Andrew Wilford

(57) ABSTRACT

The invention concerns an electrical cartridge heater (1) with supply cable (7), wherein the cartridge heater (1) comprises a metal jacket (2), in which at least one electrical conductor (3) is arranged in an insulated fashion, which conductor is connected with a metal terminal pin (6) protruding from the jacket (2), wherein the supply cable (7) is exposed at an end region, is enclosed in the exposed region by a housing, wherein the housing encloses a contact bush (10) fixed at the free end of the supply cable (7), into which contact bush the terminal pin (6) can be inserted or is inserted, wherein finally the housing is connected or can be connected immediately detachably with the cartridge heater (1), which while keeping the advantage of the easy exchangeability of the cartridge heater without supply cable, secures a simplified manufacture, a safe assembly and a high tightness against environmental influences such as hydraulic oil, splash or surge water.

6 Claims, 1 Drawing Sheet

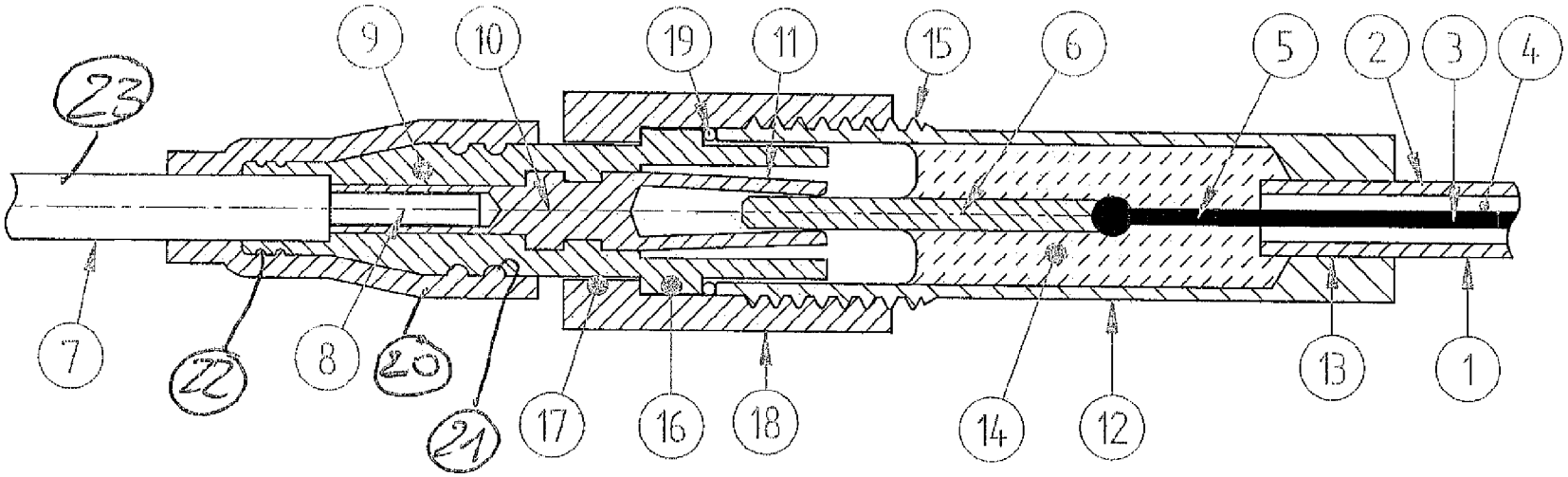
4
3
2
5
6
15
11
19
10
9
23
1
13
12
14
18
16
17
21
20
8
22
7

ELECTRICAL CARTRIDGE HEATER WITH SUPPLY CABLE

FIELD OF THE INVENTION

The invention concerns an electrical cartridge heater with supply cable, wherein the cartridge heater comprises a metal jacket, in which at least one electrical conductor is arranged in an insulated fashion, which conductor is connected with a metal terminal pin protruding from the jacket, wherein the supply cable is exposed at an end region, is enclosed in the exposed region by a housing, wherein the housing encloses a contact bush fixed at the free end of the supply cable, into which contact bush the terminal pin can be inserted or is inserted, wherein finally the housing is connected or can be connected immediately detachably with the cartridge heater.

BACKGROUND OF THE INVENTION

From the DE 34 27 207 C2, such an arrangement is known in the art. The advantage of the prior art design is that it is possible in a simple way in case of a defective cartridge heater to replace just this cartridge heater, without that the supply line needs to be newly laid. Rather, the electrical supply line can remain at its original position. This is in particular important for usual injection molding tools, which are heated with such cartridge heaters, since such injection molding tools often comprise several hundred such cartridge heaters including supply cables. Such a design is not only advantageous for laid cartridge heaters including supply cables, but it is also advantageous that such cartridge heaters can separately be manufactured and stored and the respective supply cables in different lengths can also be assembled as standard and stored. If a corresponding combination is to be used, an electrical cartridge heater is combined with a matching supply cable. In the prior art embodiment, the cartridge heater has a small diameter of for instance 4 mm.

It is disadvantageous in the prior art embodiment that the supply cable is enclosed in an end region by a stable ceramic insulator, in which the contact sleeves are arranged, this insulator being enclosed by a metal housing. In addition, sealing elements in the form of a silicone plug have to be accommodated in the housing, and the sealing between the electrical supply line and the housing as well as the parts in the housing is problematic. Further, the detachable connection of the housing with the jacket of the cartridge heater is complicated, since in fact in the prior art there is mentioned a threaded connection, wherein however with this design the enclosing housing must be arranged rotatably relative to the insulator together with the plug. This further leads to substantial problems with regard to the sealed design and arrangement against environmental influences.

OBJECT OF THE INVENTION

Based on this prior art, it is the object of the invention to provide an electrical cartridge heater with supply cable that, while keeping the advantage of the easy exchangeability of the cartridge heater without supply cable, a simplified manufacture, secures a safe assembly and a high tightness against environmental influences such as hydraulic oil, splash or surge water. Further, a high tensile strength between the cartridge heater and the inserted supply cable is desired.

SUMMARY OF THE INVENTION

For achieving this object, the invention proposes that on the end side of the cartridge heater a metal sleeve is attached and is connected in a stable and fluid-tight manner with the jacket of the cartridge heater, into which the end of the electrical conductor of the cartridge heater projects, that the end of the conductor with the metal terminal pin is connected within the sleeve, wherein the terminal pin protrudes to the orifice of the sleeve facing away from the cartridge heater or projects beyond the latter, that the sleeve protrudes or projects beyond the latter, that the sleeve is filled in the region, into which the end of the cartridge heater projects and in which the conductor is connected with the terminal pin, as well as over a portion of the length of the terminal pin with insulating material, in particular a glass melt, by means of which a sealed, centered and mechanically solid arrangement of the parts relative to each other is obtained, that the sleeve comprises an external thread at its end facing away from the cartridge heater, that the contact bush fixed at the free end of the supply cable including the end region of the supply cable following thereto is enclosed by an integral plastic part, which openly terminates with the insertion opening of the contact bush and can be inserted into the sleeve, so that the terminal pin engages in the contact bush, that at the jacket of the plastic part spaced to its open end an outwardly projecting entraining member is provided, at which a collar of a cap nut is supported, which is rotatably arranged on the plastic part and can be or is screwed with its internal thread on the external thread of the sleeve, wherein in a region between a front face of the entraining member and a front face of the sleeve a sealing element is arranged, and that finally the plastic part is enclosed in the region between the gripping part of the cap nut to the exiting supply cable as well as over a portion of the supply cable, which projects beyond the plastic part, by a shrink tube and is sealed by the latter.

According to this embodiment, on the one hand the arrangement and design sealed against environmental influences of a first element at the body of the cartridge heater is secured in a simple way and on the other hand such an embodiment at the end of the supply cable, wherein both elements can be plugged together in a simple way and can be fixed in a simple way by the cap nut, wherein also in the separating region between the two parts an excellent sealing is obtained. Such an embodiment permits a slim arrangement of the coupling components, so that the required installation frame is relatively small. The cartridge heaters to be connected may be standard components, which are manufacture in a conventional way and are available. Further, the electrical supply cable is a standard component, which is available without particular measures.

In the design according to the invention it is preferred that the sealing element is an O-ring.

It is in particular preferred that the sealing element is made of high temperature resistant silicone.

Furthermore it is preferred that the plastic part is made of high temperature resistant, injectable plastic material.

Furthermore it is particularly preferred that the shrink tube is made on its outside of a layer of thermosetting polytetrafluoroethylene (PTFE) and on its inside of a high temperature protective adhesive, preferably FEP.

It is further provided that the supply cable comprises a jacket made of PTFE.

In particular with the latter combination is achieved that when applying the shrink tube by temperature exposure, not only the shrinkage of the tube is effected, but the high temperature hot melt adhesive (FEP) on its inside is fused and excellently binds with the PTFE jacket of the supply cable, so that a tight arrangement is achieved.

A preferred embodiment of the invention is shown in the drawing and is described in the following in more detail.

BRIEF DESCRIPTION OF THE DRAWING

The single FIGURE shows an electrical cartridge heater with attached supply cable in a centrally longitudinal section.

SPECIFIC DESCRIPTION

In the drawing, an electrical cartridge heater 1 is shown that comprises a metal jacket 2. This jacket is for instance a tube made of stainless steel with a dimension in the order of 2-4 mm being usual. At the cartridge heater is arranged an electrical conductor 3, which is enclosed by an electrically insulating, heat-conducting layer 4 made of for instance MgO. In the unheated end region of the cartridge heater 1, a pin 5 made of metal may be provided, which is connected with the electrical conductor 3 and projects beyond the orifice of the cartridge heater 1, as shown in the drawing. Instead, the conductor 3 could also be extended and project beyond the orifice of the cartridge heater 1, as is shown by the pin 5. The end region or the pin 5 may be connected with a metal terminal pin 6 that is preferably made of nickel. The connection of the elements 5 and 6 may be made by welding, by plug connection or in another suitable way.

The supply cable 7 may be a conventional insulated cable with an inside conductor. The edge of the conductor 8 is exposed, the supply cable 7 being enclosed at least in the exposed region by a housing 9. The housing 9 additionally encloses a contact bush 10 made of metal fixed at the free end of the conductor 8. Into this contact bush 10, in the region 11, the terminal pin 6 can be inserted or is inserted (as shown in the drawing). In the intended mounting position, the housing 9 is detachably connected with the cartridge heater 1.

On the end side of the cartridge heater 1, a metal sleeve 12, for instance made of stainless steel, is attached and is connected in a stable and fluid-tight manner in a region 13 with the jacket of the cartridge heater 1. Into the cavity enclosed by the metal sleeve 12 fits the end of the cartridge heater 1 as well as the pin 5 respectively the terminal pin 6. The end of the conductor 3 or of the pin 5 is connected with the metal terminal pin 6 within the sleeve 12, with the terminal pin 6 protruding to the orifice of the sleeve 12 facing away from the cartridge heater 1 or even slightly projecting beyond the latter.

The cavity of the sleeve 12 that encloses the end of the cartridge heater 1 as well as the pin 5 and in part the terminal pin 6, is filled with insulating material 14. In the embodiment, the insulating material is a glass melt, by means of which the pin 5 and the terminal pin 6 is centered and mechanically held as well as sealed against the environment in the direction of the cartridge heater 1.

In addition, the sleeve 12 comprises at its end facing away from the cartridge heater 1 an external thread 15.

The contact bush 10 fixed at the free end of the supply cable 7 together with the following end regions of the supply cable 7 is enclosed by an integral plastic part 9. The latter terminates openly with the insertion opening of the contact bush 10. This end can be inserted into the sleeve 12, so that the terminal pin 6 can slide into the contact region 11 of the contact bush 10 and makes contact there, as shown in the drawing.

At the jacket of the plastic part 9, spaced from its open end, an outwardly projecting entraining member 16 in the form of a circumferential collar is formed, at which a collar 17 of a cap nut 18 is supported that is rotatably arranged on the plastic part 9 and is screwed with its internal thread on the external thread 15 of the sleeve 12. In the gap 19 that is formed between a front face of the entraining member 16 and a front face of the sleeve 12, a sealing element is arranged (this is not shown in the drawing).

The plastic part 9 in turn is enclosed in the region between the gripping part of the cap nut 18 with the collar 17 to the exiting supply cable 7 as well as over a portion of the supply cable 7 that projects beyond the plastic part 9, by a shrink tube 20, wherein in the desired position a sealing of this region is effected. For improving the seat, the plastic part 9 comprises ribs 21, 22, in which the material of the shrink tube 20 can engage.

The sealing element to be arranged in the region 19 is preferably an O-ring that is made of high temperature resistant silicone.

The plastic part 9 is preferably made of high temperature resistant injectable plastic material. The shrink tube 20 is preferably a so-called dual shrink tube, which is made on the outside of a thermosetting PTFE layer and on the inside of an FEP layer. This FEP is a high temperature hot melt adhesive that melts at a corresponding temperature, which is suitable for the shrinkage of the shrink tube 20, and excellently and tightly binds with the PTFE jacket of the supply cable 7.

In order to make an approximate statement with regard to the dimensions of this device, it is pointed out that the cap nut may be an M5 nut, thus preferably the complete coupling element having a maximum diameter of approx. 6 mm.

The invention provides a high temperature resistant element consisting of an electrical cartridge heater 1, of a supply cable 7 and coupling elements, wherein by the arrangement according to the invention a simple handling for the connection and for the release of the supply cable from the cartridge heater is permitted, a high tightness of the complete assembly against environmental influences is achieved and an economic manufacture of the individual elements is permitted.

The invention is not limited to the described embodiment, but is in many ways variable within the scope of the disclosure.

All novel individual or combined features disclosed in the description and/or the drawing are deemed essential for the invention

We claim:

1. An electrical cartridge heater with supply cable, wherein the cartridge heater comprises a metal jacket, in which at least one electrical conductor is arranged in an insulated fashion, which conductor is connected with a metal terminal pin protruding from the jacket, wherein the supply cable is exposed at an end region, is enclosed in the exposed region by a housing, wherein the housing encloses a contact bush fixed at the free end of the supply cable, into which contact bush the terminal pin can be inserted or is inserted, wherein finally the housing is connected or can be connected immediately detachably with the cartridge heater, characterized in that on the end side of the cartridge heater a metal sleeve is attached and is connected in a stable and fluid-tight manner with the jacket of the cartridge heater, into which the end of the electrical conductor of the cartridge heater projects, that the end of the conductor with the metal terminal pin is connected within the sleeve, wherein the terminal pin protrudes to the orifice of the sleeve facing away from the cartridge heater or projects beyond the latter, that the sleeve protrudes or projects beyond the latter, that the sleeve is filled in the region, into which the end of the cartridge heater projects and in which the conductor is connected with the terminal pin, as well as over a portion of the length of the terminal pin with insulating material, in particular a glass melt, by means of which a sealed, centered and mechanically solid arrangement of the parts relative to each other is obtained, that the sleeve comprises an external thread at its end facing away from the cartridge heater, that the contact bush fixed at the free end of the supply cable including the end region of the supply cable following thereto is enclosed by an integral plastic part, which openly terminates with the insertion opening of the contact bush and can be inserted into the sleeve, so that the terminal pin engages in the contact bush, that at the jacket of the plastic part spaced to its open end an outwardly projecting entraining member is provided, at which a collar of a cap nut is supported, which is rotatably arranged on the plastic part and can be or is screwed with its internal thread on the external thread of the sleeve, wherein in a region between a front face of the entraining member and a front face of the sleeve a sealing element is arranged, and that finally the plastic part is enclosed in the region between the gripping part of the cap nut to the exiting supply cable as well as over a portion of the supply cable, which projects beyond the plastic part, by a shrink tube and is sealed by the latter.

2. The cartridge heater with supply cable according to claim 1, wherein the sealing element is an O-ring.

3. The cartridge heater with supply cable according to claim 1 wherein the sealing element is made of high temperature resistant silicone.

4. The cartridge heater with supply cable according to claim 1 wherein the plastic part is made of high temperature resistant, injectable plastic material.

5. The cartridge heater with supply cable according to claim 1 wherein the shrink tube is made on its outside of a layer of thermosetting polytetrafluoroethylene and on its inside of a high temperature protective adhesive, preferably FEP.

6. The cartridge heater with supply cable according to claim 1 wherein the supply cable comprises a jacket made of PTFE.

* * * * *